US010274274B2

(12) United States Patent
Kwon

(10) Patent No.: US 10,274,274 B2
(45) Date of Patent: Apr. 30, 2019

(54) GUN MAGAZINE AUTOMATIC CHANGING APPARATUS

(71) Applicant: Yoon Gu Kwon, Gwangmyeong-si (KR)

(72) Inventor: Yoon Gu Kwon, Gwangmyeong-si (KR)

( * ) Notice: Subject to any disclaimer, the term of this patent is extended or adjusted under 35 U.S.C. 154(b) by 0 days.

(21) Appl. No.: 16/027,764

(22) Filed: Jul. 5, 2018

(65) Prior Publication Data

US 2019/0011205 A1 Jan. 10, 2019

(30) Foreign Application Priority Data

Jul. 6, 2017 (KR) ..... 10-2017-0085738

(51) Int. Cl.

| | |
|---|---|
| ***F41A 9/68*** | (2006.01) |
| ***F41A 9/23*** | (2006.01) |
| *F41A 9/59* | (2006.01) |
| *F41A 9/41* | (2006.01) |
| *F41A 9/56* | (2006.01) |
| *F41A 9/22* | (2006.01) |

(52) U.S. Cl.

CPC ..... *F41A 9/68* (2013.01); *F41A 9/23* (2013.01); *F41A 9/22* (2013.01); *F41A 9/41* (2013.01); *F41A 9/56* (2013.01); *F41A 9/59* (2013.01)

(58) Field of Classification Search

CPC ..... F41A 9/68; F41A 9/23; F41A 9/22; F41A 9/41; F41A 9/56; F41A 9/59

USPC ..... 42/18, 49.01, 90

See application file for complete search history.

(56) References Cited

U.S. PATENT DOCUMENTS

| | | | | |
|---|---|---|---|---|
| 6,698,129 | B1 * | 3/2004 | Hanks | F41A 9/63 42/90 |
| 8,640,374 | B1 * | 2/2014 | Reichelt | F41C 27/00 42/106 |
| 9,581,400 | B2 * | 2/2017 | Dove | F41A 9/01 |
| 2013/0312726 | A1 * | 11/2013 | Mead | F41A 9/26 124/78 |

(Continued)

FOREIGN PATENT DOCUMENTS

KR 10-1603186 B1 3/2016

OTHER PUBLICATIONS

KIPO Notice Requesting Submission of Opinion dated Nov. 13, 2017 in related KR Appln. No. 2017-0085738, in English and Korean languages.

(Continued)

*Primary Examiner* — Samir Abdosh

(74) *Attorney, Agent, or Firm* — Harness, Dickey & Pierce, PLC

(57) ABSTRACT

A gun magazine automatic changing apparatus is disclosed. According to an embodiment, a gun magazine automatic changing apparatus is combined with a gun having a barrel, a barrel cover, a receiver connected to the rear end of the barrel, and a magazine chamber. The gun magazine automatic changing apparatus includes: a multi-magazine mount including a plurality of clips each having a holder fitted on a magazine and connectors disposed on both sides of the holder and having fitting units at both ends; and a loading guide including an actuating bar pushing down the connectors of the multi-magazine mount and a holder formed at an end of the actuator bar to be held by a user and disposed under the barrel cover to move forward/backward.

7 Claims, 17 Drawing Sheets

(56) References Cited

U.S. PATENT DOCUMENTS

2014/0223791 A1* 8/2014 Ruby ..... F41C 27/00
42/49.01

OTHER PUBLICATIONS

KIPO Decision to Grant a Patent in related KR Appln. No. 2017-0085738 dated Jan. 22, 2018, in English and Korean languages.

* cited by examiner

GUN MAGAZINE AUTOMATIC CHANGING APPARATUS

CROSS-REFERENCE TO RELATED APPLICATION

This application claims priority to Korean Patent Application No. 10-2017-0085738, filed Jul. 6, 2017, the entire contents of which is incorporated herein for all purposes by this reference.

FIELD

The present invention relates to a magazine changing apparatus and, more particularly, to a magazine changing apparatus that can replace a magazine.

BACKGROUND

Unless stated otherwise in this specification, the contents described in this section are not the related art about the claims of this application and not all of the contents included in this section are regarded as the related art.

A gun, which is a fundamental firearm, fires with a magazine holding cartridges inserted therein, and the magazine is supposed to be replaced with new one when the cartridges are exhausted.

Recently, firearms are manufactured to be able to fire single shots and fire in rapid succession with great development in their functions, but the function is limited only to magazine capacity. Accordingly, cartridges are quickly used up in successive firing, so the cycles of replacing magazines becomes short and weakness is unavoidably betrayed during replacing magazines.

Furthermore, it wastes much time to re-aim after replacing a magazine, which causes striking ability to be deteriorated in actual warfare.

SUMMARY

An object of the present invention is to provide a gun magazine automatic changing apparatus that can quickly replace a magazine with the target maintained, thereby being able to maintain the firing efficiency in the maximum state and considerably improve striking ability.

The object of an embodiment can be achieved by a gun magazine automatic changing apparatus that is combined with a gun having a barrel, a barrel cover, a receiver connected to the rear end of the barrel, and a magazine chamber and that includes: a multi-magazine mount including a plurality of clips each having a holder fitted on a magazine and connectors disposed on both sides of the holder and having fitting units at both ends; and a loading guide including an actuating bar pushing down the connectors of the multi-magazine mount and a handle formed at an end of the actuator bar to be held by a user and disposed under the barrel cover to move forward/backward.

According to an embodiment, a magazine of a gun can be quickly replaced and the magazine can be replaced with a target maintained, thereby being able to maintain the firing efficiency in the maximum state and considerably improve striking ability.

DRAWINGS

The above and other objects, features and other advantages of the present invention will be more clearly understood from the following detailed description when taken in conjunction with the accompanying drawings, in which.

DETAILED DESCRIPTION

Figure 1:
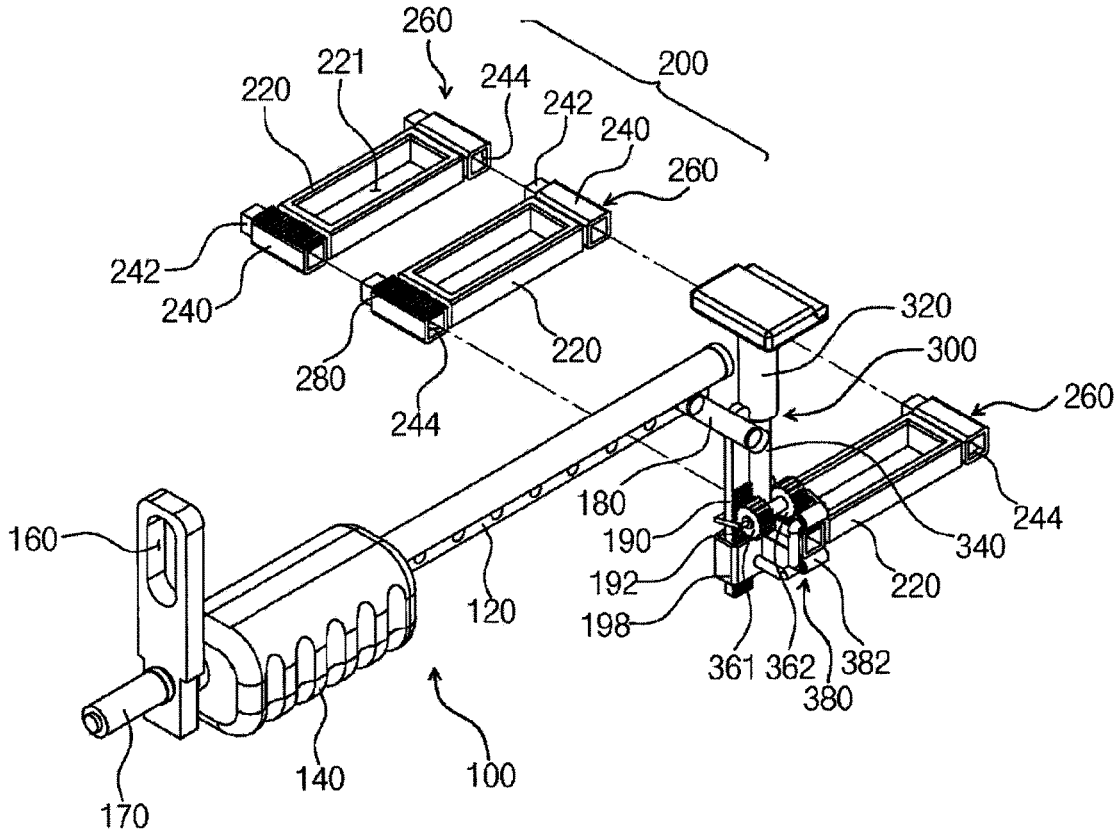
FIG. 1 is a view showing a gun magazine automatic changing apparatus according to an embodiment of the present invention.
Figure 2:
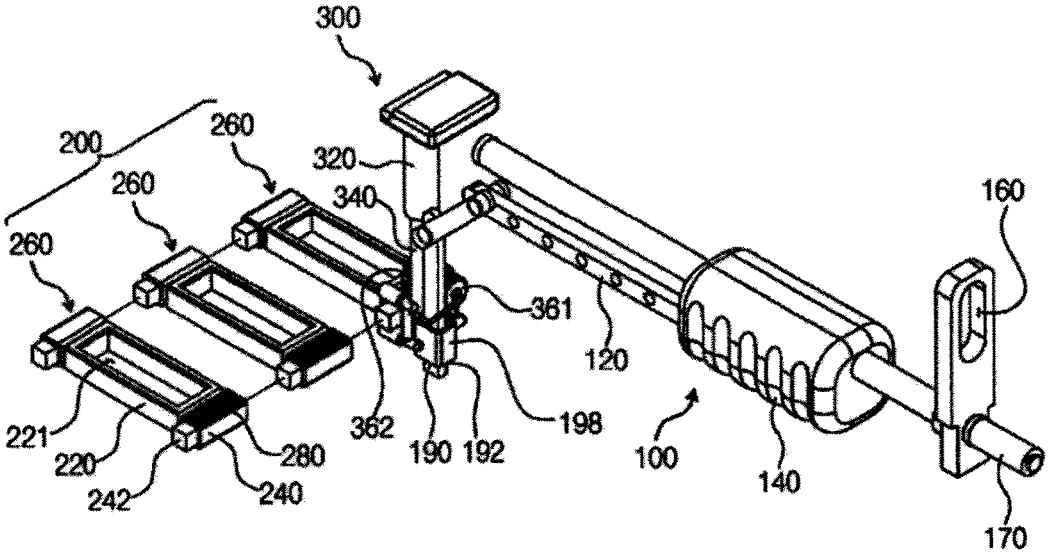
FIG. 2 is a perspective view showing in another direction the gun magazine automatic changing apparatus according to an embodiment of the present invention.
Figure 3:
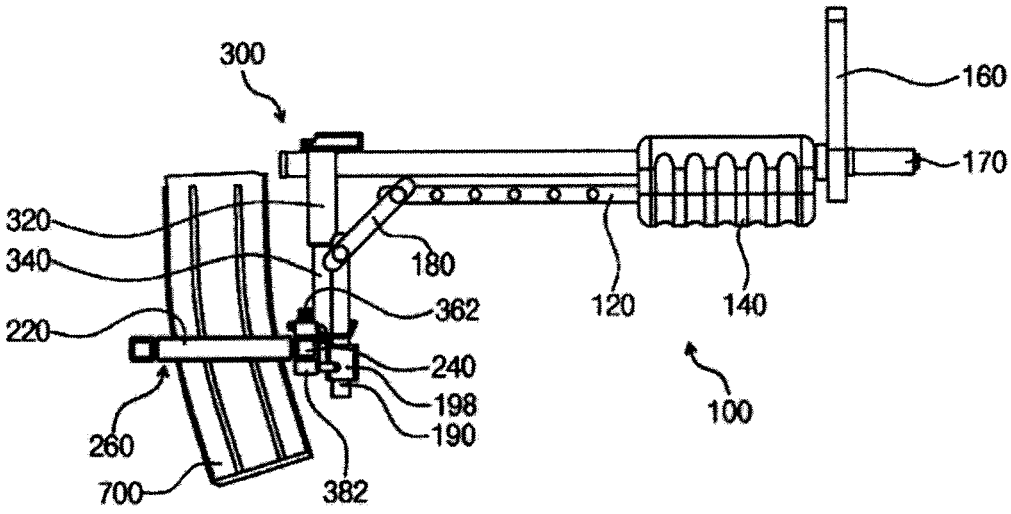
FIG. 3 is a side view showing in a direction the gun magazine automatic changing apparatus according to an embodiment of the present invention.
Figure 4:
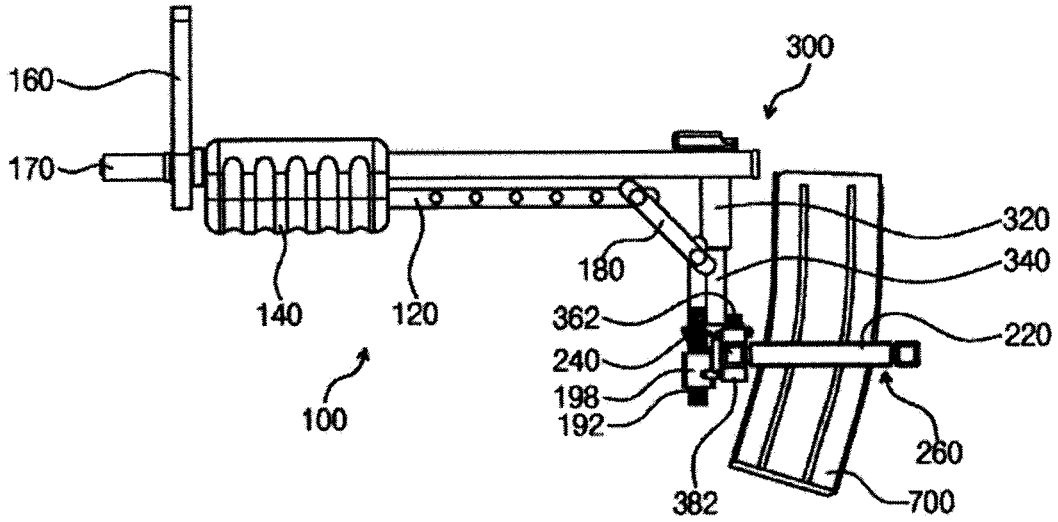
FIG. 4 is a side view showing in another direction the gun magazine automatic changing apparatus according to an embodiment of the present invention.
Figure 5:
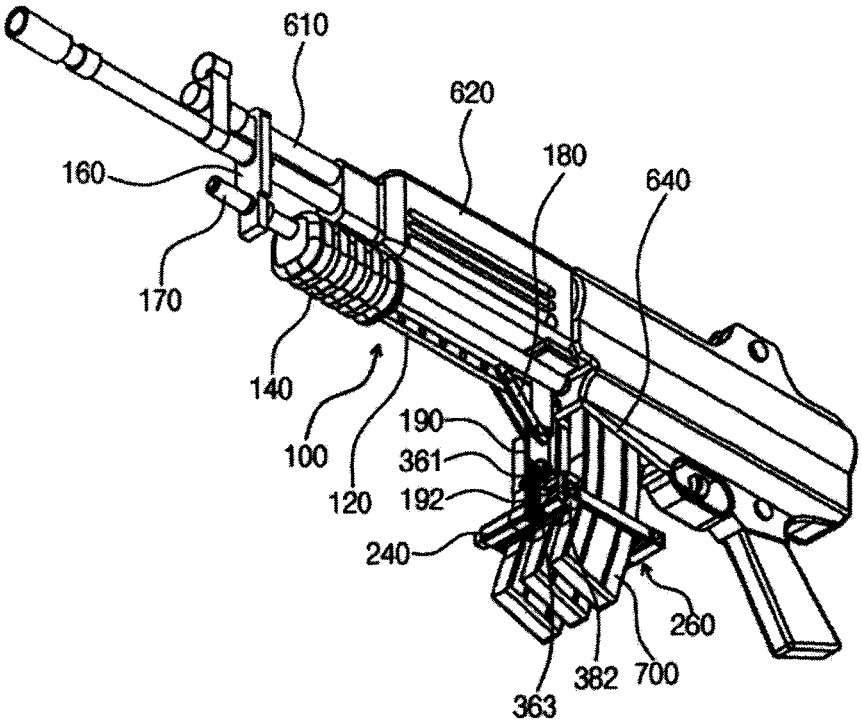
FIG. 5 is a perspective view showing an example of using the gun magazine automatic changing apparatus according to an embodiment with a gun.
Figure 6:
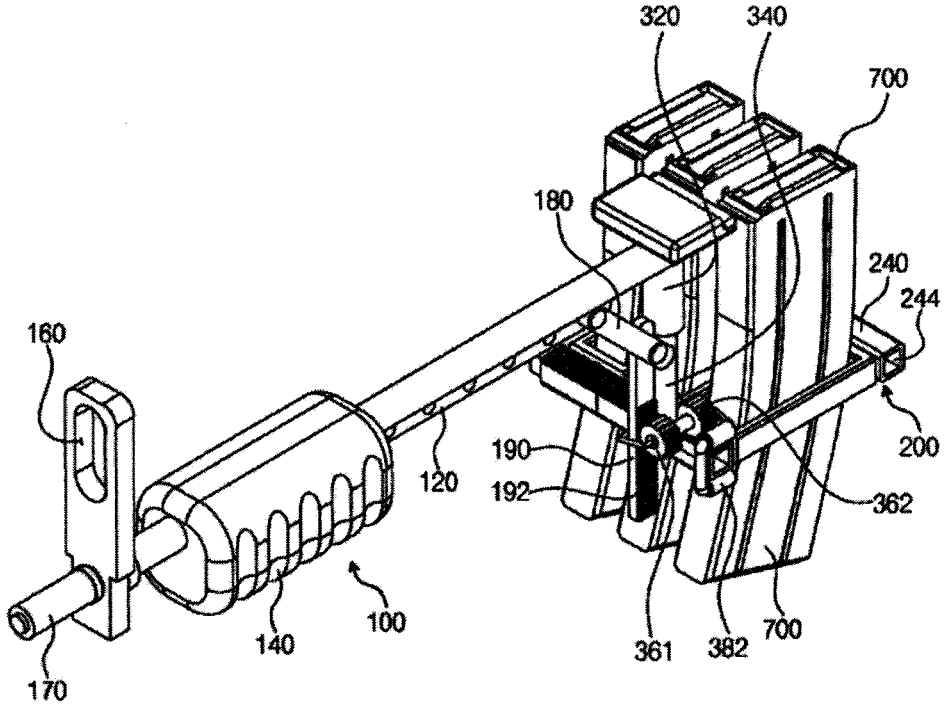
FIG. 6 is a perspective view showing an example in which the gun magazine automatic changing apparatus according to an embodiment is equipped with several magazines.
Figure 7:
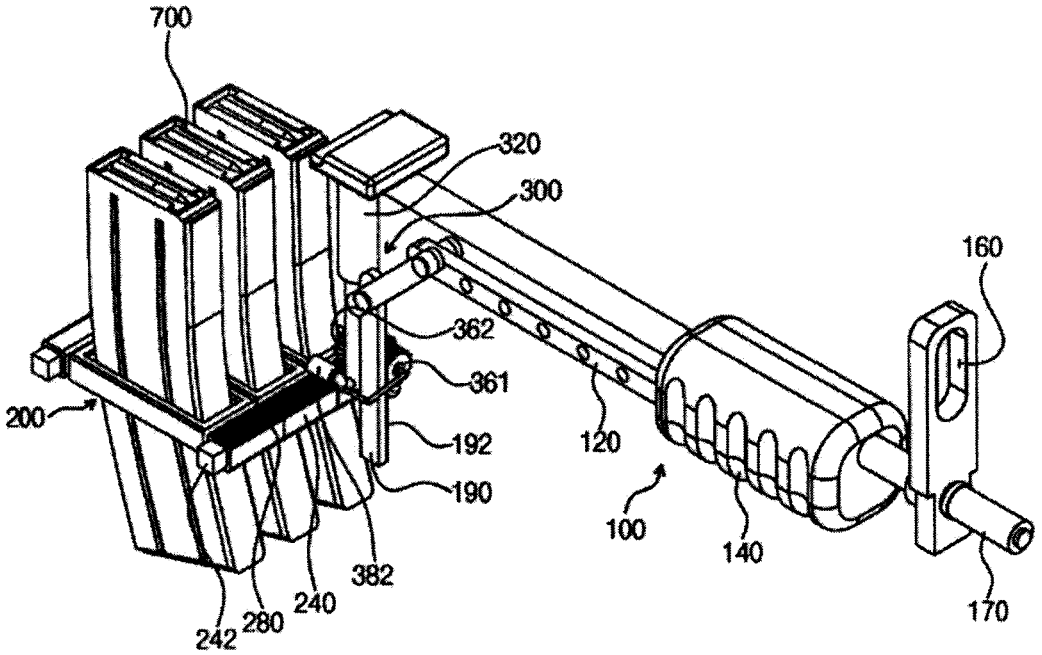
FIG. 7 is a perspective view showing FIG. 6 in another direction.
Figure 8:
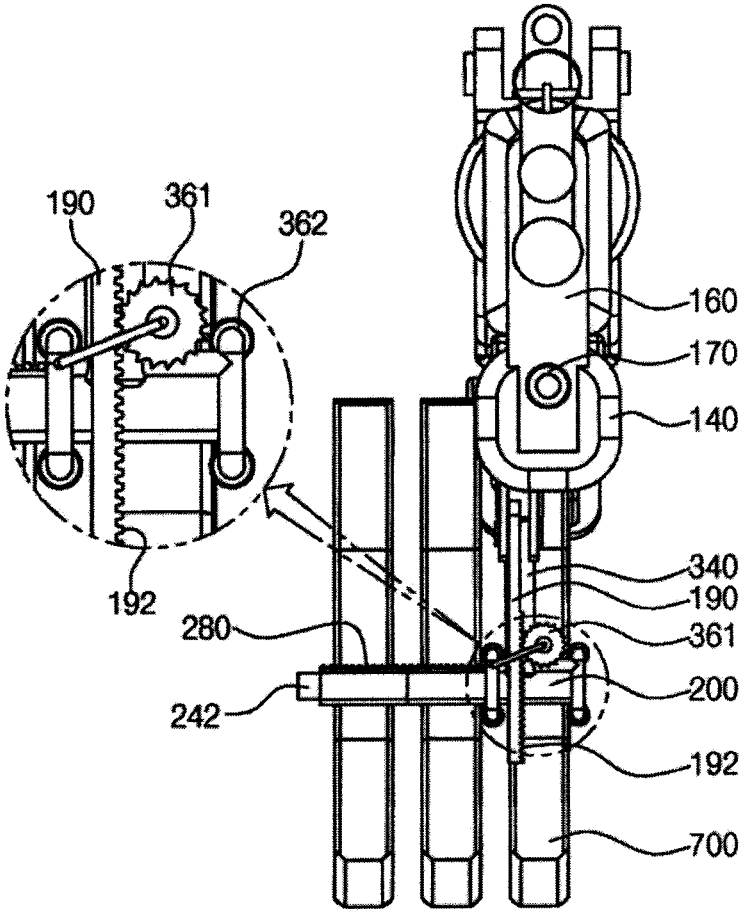
FIG. 8 is a front view showing the gun magazine automatic changing apparatus according to an embodiment of the present invention.

Hereafter, preferred embodiments will be described in detail with reference to the accompanying drawings.

The following embodiments are provided to describe the present invention so that those skilled in the art can easily achieve the present invention and the spirit and scope of the present invention are not limited thereto.

It should be noted that the sizes and shapes etc. of the components shown in the drawings may be exaggerated for clear and convenient description, terms specifically defined in consideration of the configuration and operation of the present invention may be changed by intention or custom of users and operators, and the definitions of the terms should be based on the description throughout this specification.

As shown in FIGS. 1 to 5, a gun magazine automatic changing apparatus A according to an embodiment is combined with a gun having a barrel 610, a barrel cover 620, a receiver 630 connected to the rear end of the barrel 610, and a magazine chamber 640. The gun magazine automatic changing apparatus A include: a multi-magazine mount 200 including a plurality of clips 260 each having a holder 200 fitted on a magazine 700 and connectors 240 disposed on both sides of the holder 220 and having fitting units at both ends; and a loading guide 100 including an actuating bar 120 pushing down the connectors 240 of the multi-magazine mount 200 and a handle 140 formed at an end of the actuator bar 120 to be held by a user and disposed under the barrel cover 620 to move forward/backward.

The multi-magazine mount 200 has fitting holes 221 to fit the holders 220 on the magazines 700 and the fitting holes 221 are formed substantially rectangular shapes to correspond to the cross-sectional shape of the magazines 700.

A coating layer may be formed on the inner side of the fitting holes 221 of the holders 220 to increase friction. The coating layer is made of urethane or rubber.

The connectors 240 are disposed on both sides of each of the rectangular holders 220.

The connectors 240 each have a fitting protrusion 242 at a first end and a fitting groove 244 in which the fitting protrusion 242 is inserted at a second end.

Accordingly, the connectors 240 can be continuously connected by fitting the fitting protrusions 242 and the fitting grooves 244, so the multi-magazine mount 200 has a set of about three to five clips 260.

A second rack gear 280 is longitudinally formed on the outer side of one or both of two connectors 240.

The second rack gear 280 is in mesh with second pinion gears 362 of a feeder 300.

A loading guide 100 is operated such that the handle 140 is moved backward, whereby the clips 260 are moved down to remove empty magazines 700.

The handle 140 is disposed at the front portion of the actuating bar 120 horizontally fixed at an end to a mounting holder 160 for holding the barrel 610.

Preferably, an elastic unit 170 including a spring elastically supporting the front end of the handle 140 is formed through a lower hole of the mounting holder 160 to prevent the handle 140 from shaking.

A link 180 is hinged to the rear end of the actuating bar 120. The link 180 extends downward and the rack bar 190 is vertically positioned with the upper end hinged to an end of the link 180.

A first rack gear 192 is longitudinally formed on the outer side of the rack bar 190.

A first pinion gear 361 is in mesh with the first rack gear 192.

A rack guide 198 is disposed on the rack bar 190 to guide vertical movement of the rack bar 190.

The rack guide 198 has a rectangular hole for inserting the rack bar 190. The rack guide 198 is integrally connected to a U-shaped bracket of a guide member 380.

When a user holds the handle 140 and pulls back the actuating bar 120, the rack bar 190 hinged to the link 180 is vertically moved down.

As the rack bar 190 is moved down, the first pinion gear 361 engaged with the first rack gear 192 is rotated.

The second pinion gear 362 is rotated by the rotation of the first pinion gear 361.

As the second pinion gear 362 is rotated, the second rack gear 280 is pushed and an empty magazine 700 is transversely moved.

As the empty magazine 700 is moved, a new magazine 700 is fed to a position corresponding to the magazine chamber 640.

The empty magazine 700 can be further transversely moved to be removed after being moved downward and the feeder 300 moves a new magazine 700 to the position corresponding to the magazine chamber 640.

The feeder 300 includes a cylinder 320 vertically extending downward to be coupled to the receiver 630, a rod 340 coupled to the lower end of the cylinder 320 to stretch and contract, and the first pinion gear 361 and the second pinion gear 362 hinged to the lower end of the rod 340 to rotate.

The first pinion gear 361 and the second pinion gear 362 are coupled to both sides of a shaft 363.

The first pinion gear 361 is in mesh with the first rack gear 192 and the second pinion gear 362 is in mesh with the second rack gear 280 of the connector 240.

Accordingly, when any one of the first pinion gear 361 and the second pinion gear 362 is rotated, the other one is also rotated.

Preferably, the first pinion gear 361 and the second pinion gear 362 are rotated only when the rack bar 190 is moved down, and when the rack bar 190 is moved up, they idle.

The teeth of the first pinion gear 361 and the second pinion gear 362 are formed in a right triangular shape with a hypotenuse, and preferably, the hypotenuses face down.

Accordingly, when the rack gear 192 is moved up, it comes in contact with the hypotenuses, so the first pinion gear 361 and the second pinion gear 362 are not rotated.

However, when the rack gear 192 is moved down, the first pinion gear 361 and the second pinion gear 362 are rotated. Accordingly, only when the rack bar 190 is moved down, that is, the handle 140 is pulled backward, the first pinion gear 361 and the second pinion gear 362 are rotated, so an empty magazine 700 and a new magazine 700 are moved.

The apparatus further includes a guide member 380 connected to the lower end of the rod 340, having a plurality of rollers 382 supporting the tops and bottoms of the connectors 240, and having a U-shaped bracket combined with the rollers 382.

Figure 17:
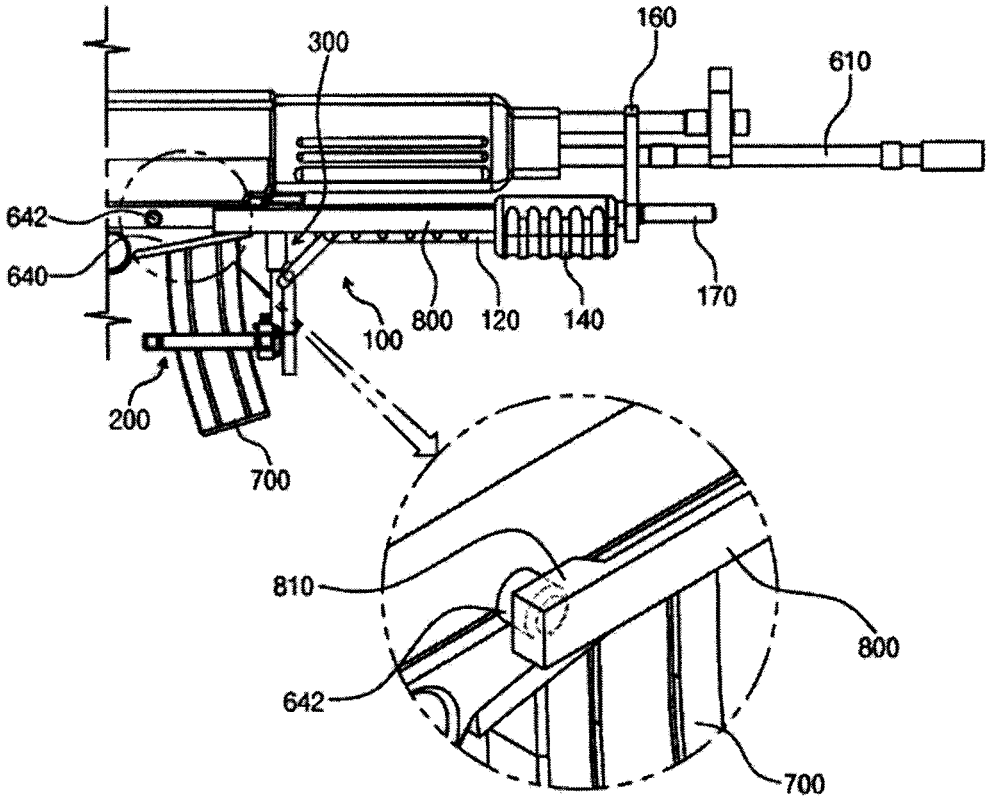
FIG. 17 is a view showing a magazine catch button pusher of the gun magazine automatic changing apparatus according to an embodiment of the present invention.

Meanwhile, as shown in FIG. 17, a magazine catch button pusher 800 is connected to the handle 140 in parallel with the actuating bar 120 to press a magazine catch button 642.

The magazine catch button pusher 800 is a stick fixed at an end to a side of the handle 140 and disposed in parallel with the actuating bar 120 and has an arc protrusion 810 at an end to be able to press the magazine catch button 642.

Accordingly, when the handle 140 is moved backward, the magazine catch button pusher 800 is moved backward and presses the magazine catch button 642, the magazine 700 fitted in the magazine chamber 640 is released.

Hereinafter, the operation of the present invention having this configuration is described.

Figure 9:
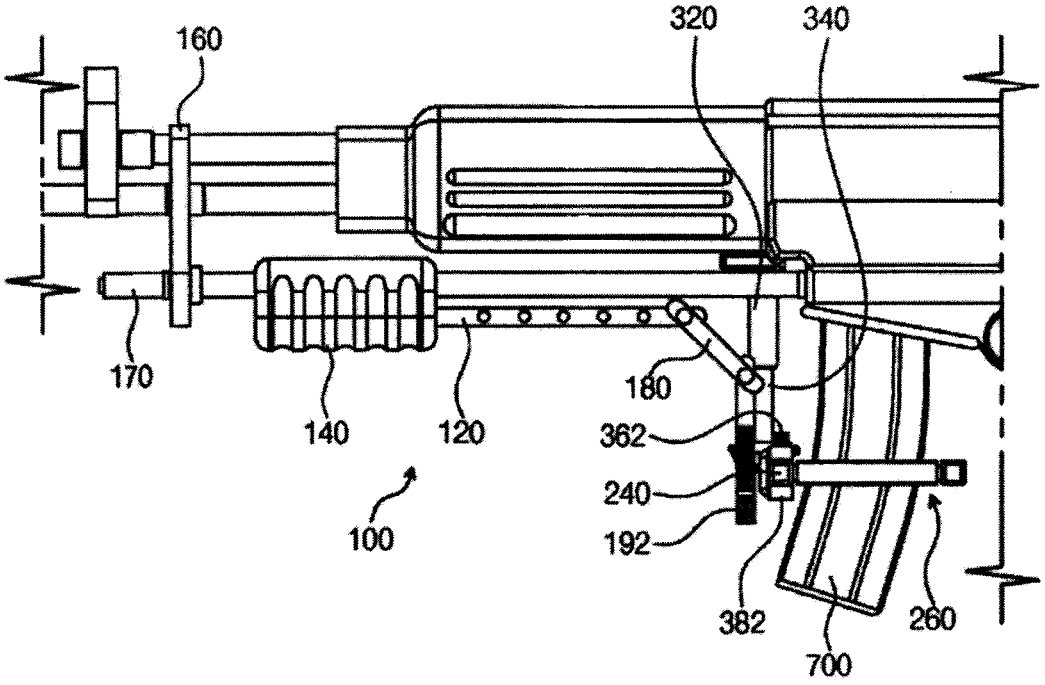
FIG. 9 is a side view before the gun magazine automatic changing apparatus according to an embodiment of the present invention is operated.
Figure 10:
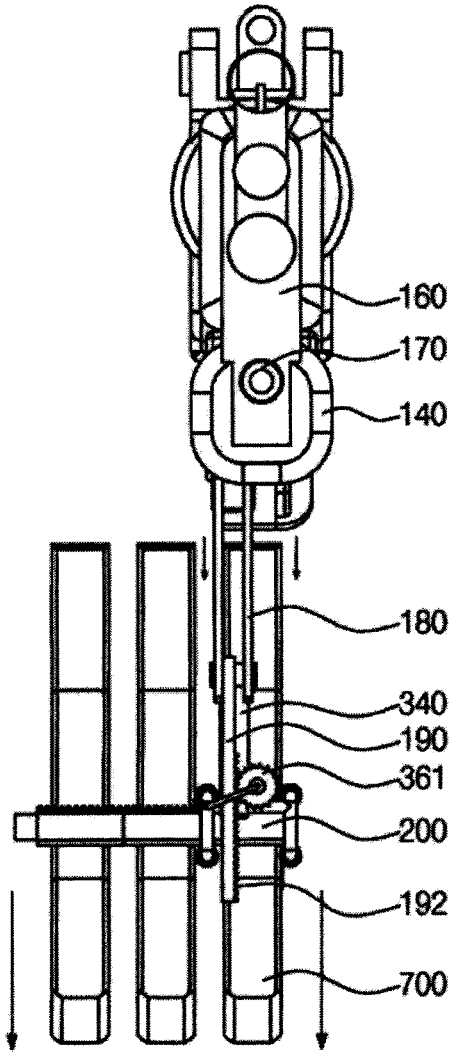
FIG. 10 is a front view of FIG. 9.

As shown in FIGS. 9 and 10, magazines 700 are inserted in the magazine mount 640.

Figure 11:
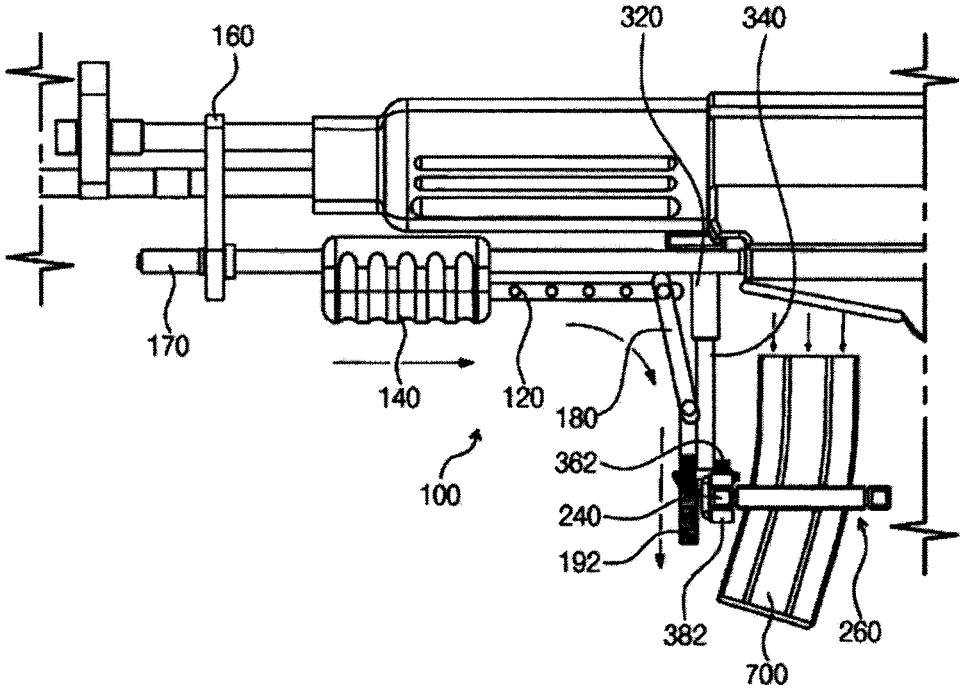
FIG. 11 is a side view showing the state in which a handle has been primarily pulled back and then a magazine has been separated by the gun magazine automatic changing apparatus according to an embodiment of the present invention.
Figure 12:
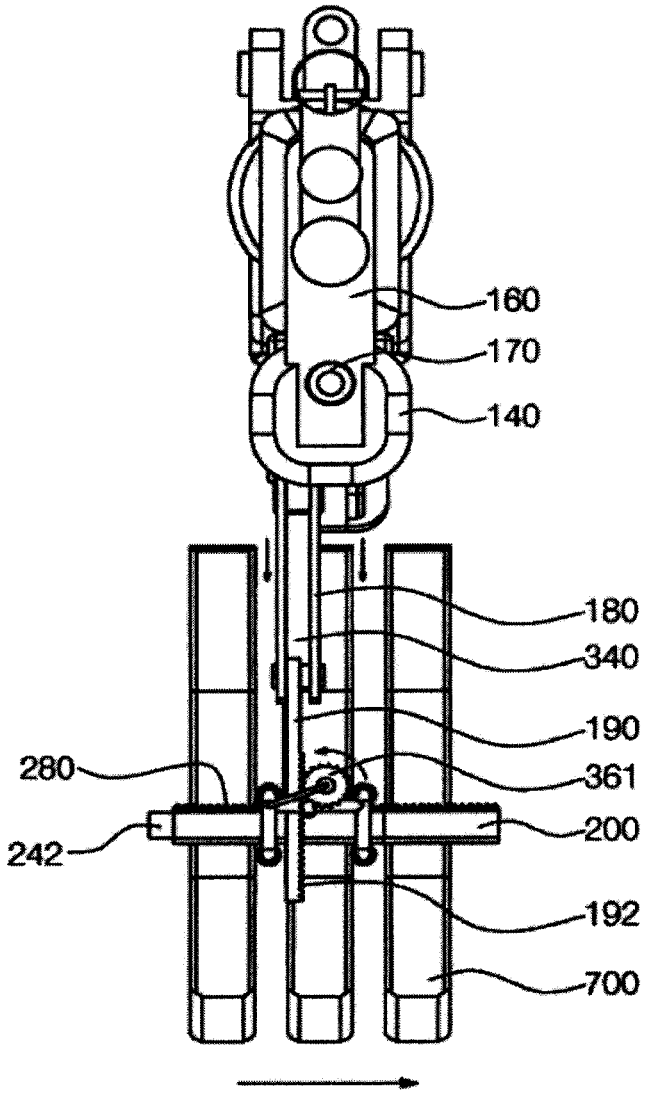
FIG. 12 is a front view of FIG. 11.

As shown in FIGS. 11 and 12, when the handle 140 is further pulled backward, the actuating bar 120, the link 180, and the rack bar 190 are moved down. The first pinion gear 361 engaged with the first rack gear 192 cannot be rotated yet and only a force pressing down the multi-magazine mount 200 is applied with the force moving down the rack bar 190.

Since the magazines 700 are inserted in the magazine chamber 640, even though the rack bar 190 is moved down, the first pinion gear 361 cannot be rotated.

Figure 13:
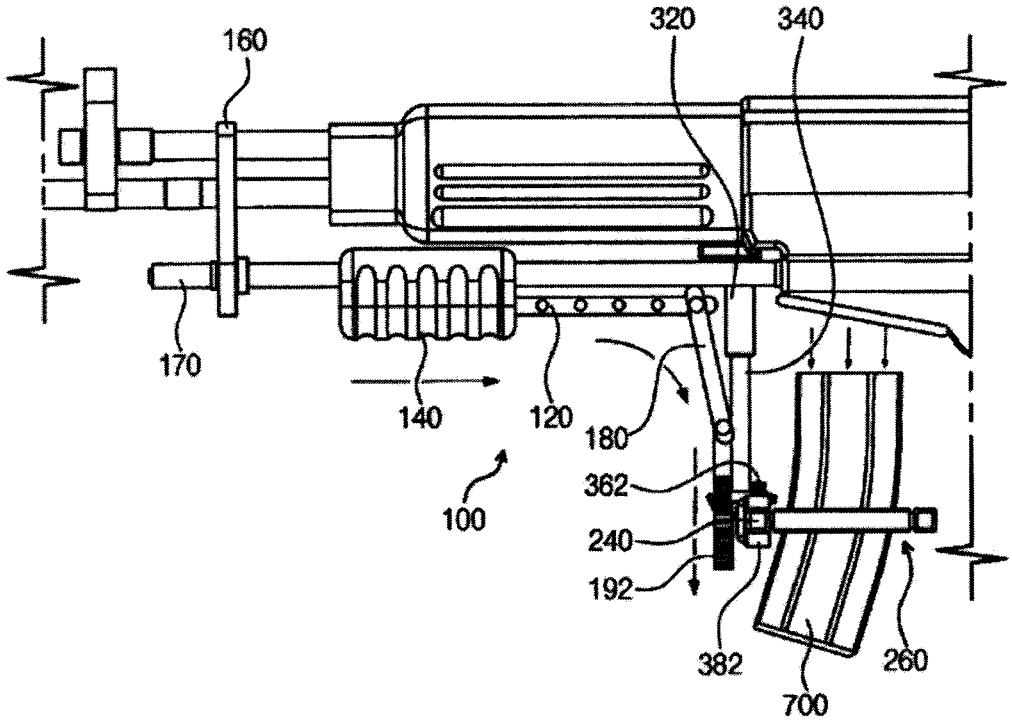
FIG. 13 is a side view showing the state in which a handle has been secondarily pulled back and then a magazine has been separated by the gun magazine automatic changing apparatus according to an embodiment of the present invention.
Figure 14:
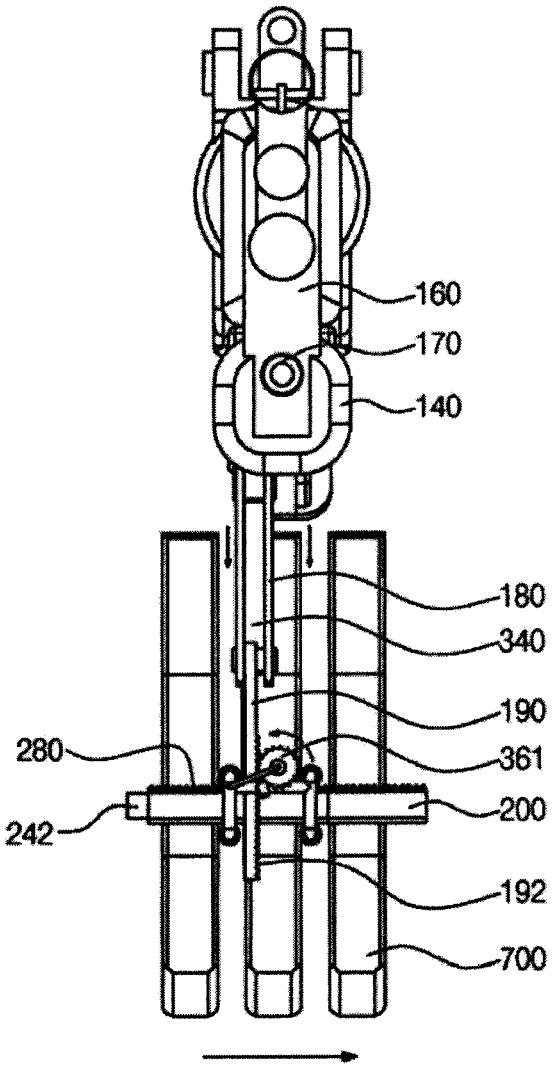
FIG. 14 is a front view of FIG. 13.
Figure 18:
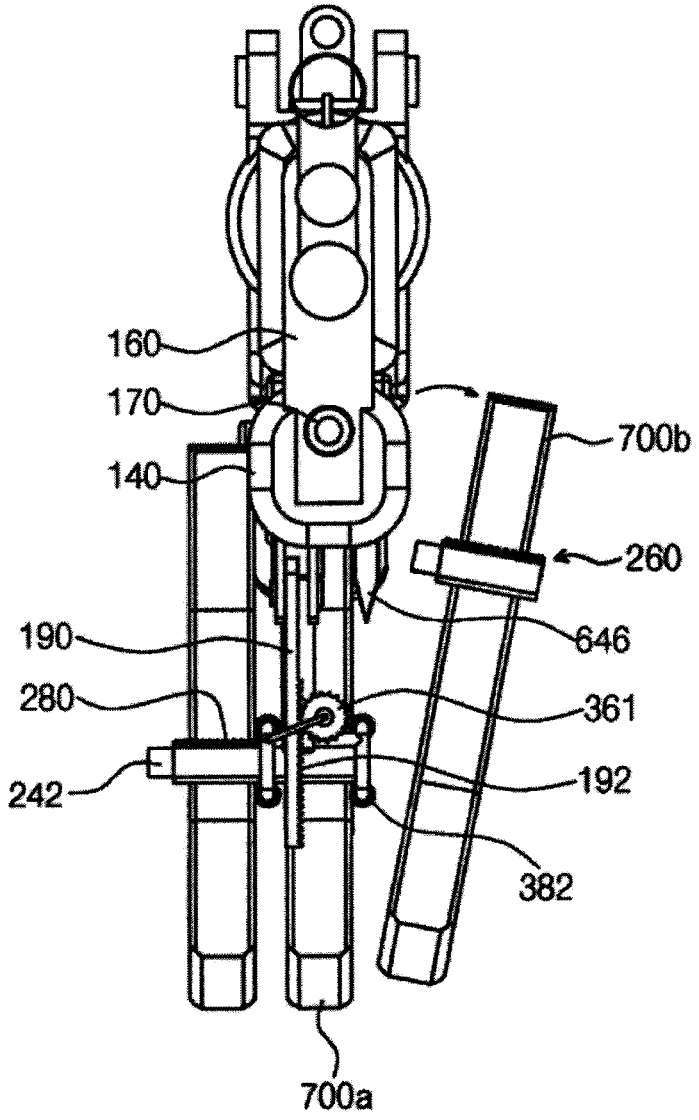
FIG. 18 is a view showing a magazine ejector of the gun magazine automatic changing apparatus according to an embodiment of the present invention.

Thereafter, as shown in FIGS. 13, 14, and 18, when a magazine is released out of the magazine chamber 640, the first pinion gear 361 engaged with the first rack gear 192 of the rack bar 190 is rotated and the second pinion gear 362 is also rotated.

Since the second pinion gear 362 pushes the engaged second rack gear 280, the clip 260 combined with the empty magazine 700 is transversely moved with the empty magazine 700*b* and a new magazine 700*a* is fed to a position corresponding to the magazine chamber 640.

Figure 15:
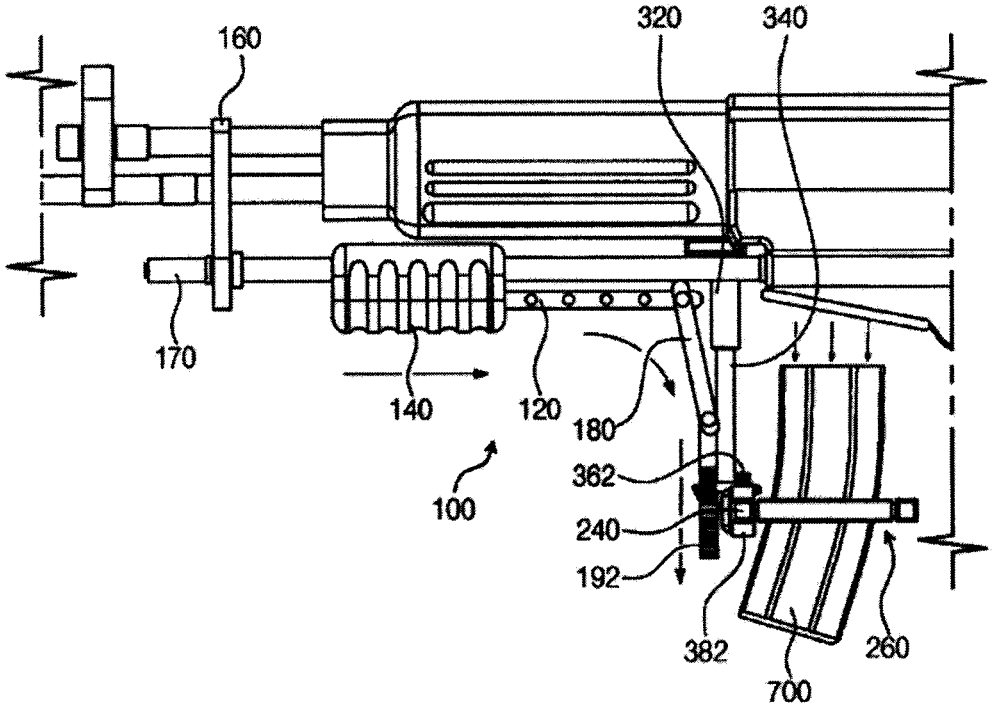
FIG. 15 is a side view showing a process of pushing the handle forward and fitting a magazine by the gun magazine automatic changing apparatus according to an embodiment of the present invention is operated.
Figure 16:
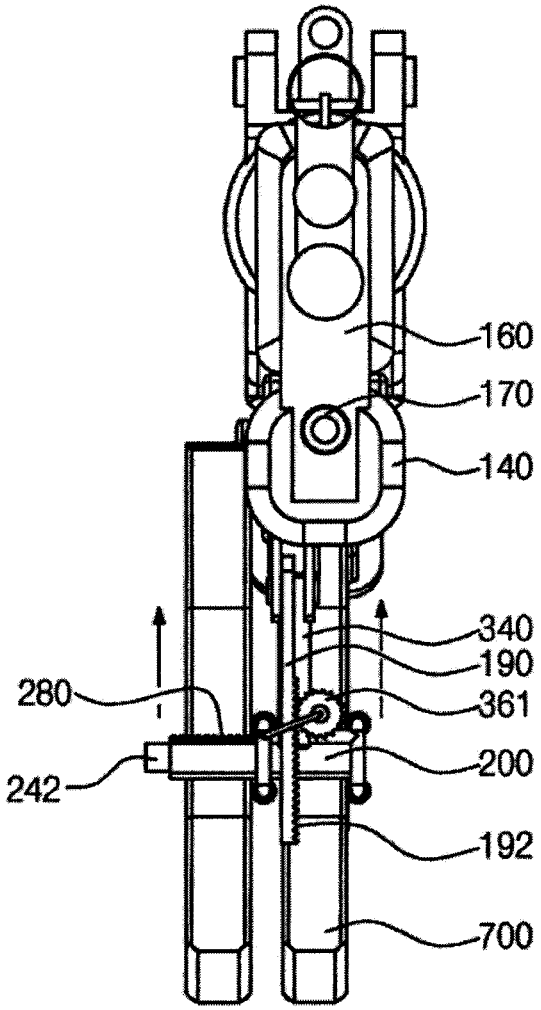
FIG. 16 is a front view of FIG. 15.

Thereafter, as shown in FIGS. 15 and 16, when the handle 140 is moved forward, the actuating bar 120, the link 180, and the rack bar 190 are moved up and the first pinion gear 361 engaged with the first rack gear 192 is moved up with the rack bark 190 without rotating and moves up a clip 260, so a new magazine 700 can be fitted into the magazine chamber 640.

Meanwhile, as shown in FIG. 18, a magazine ejector 646 that can completely separate a clip 260 with a empty magazine 700 outward from the clip 260 of a new magazine 700 is further included.

The magazine ejector 646 is formed outside the magazine chamber 640 and has a pointed end inserted between adjacent clips 260 of the multi-magazine mount 200.

Since the magazine ejector 646 is disposed between an empty magazine 700 and a new magazine 700 that are adjacent to each other and the new magazine 700 is fitted in the magazine chamber 640, the empty magazine 700 can be separated outside by separation of the connectors 240 of the empty magazine 700.

Although the present invention was described with reference to a preferred embodiment, it would be easily understood by those skilled in the art that the present invention may be changed and modified in various ways without departing from the spirit of the present invention, and it is apparent that the changes and modification are included in the following claims.

What is claimed is:

1. A gun magazine automatic changing apparatus that is combined with a gun having a barrel, a barrel cover, a receiver connected to a rear end of the barrel, and a magazine chamber comprises:

a multi-magazine mount including holders fitted on magazines, connectors disposed on both sides of each of the holders and each having a fitting protrusion at a first end, a fitting groove in which the fitting protrusion is fitted at a second end, and a second rack gear longitudinally formed on an outer side thereof, and a plurality of clips connected to each other; and a loading guide including an actuating bar pushing down the connectors of the multi-magazine mount and a handle formed at an end of the actuator bar to be held by a user and disposed under the barrel cover to move forward/backward.

2. The apparatus of claim 1, wherein the loading guide includes a link hinged to a rear end of the actuating bar and a rack bar hinged to an end of the link to move up and down and having a first rack gear, and the apparatus includes a feeder transversely moving the magazines after the magazines are moved down to move an empty magazine and feed a new magazine to a position corresponding to the magazine chamber.

3. The apparatus of claim 2, wherein the feeder includes a cylinder vertically extending downward to be coupled to the receiver, a rod coupled to the lower end of the cylinder to stretch and contract, and a first pinion gear and a second pinion gear hinged to a lower end of the rod to rotate, the first pinion gear is in mesh with the first rack gear, and the second pinion gear is in mesh with the second rack gear of the connector.

4. The apparatus of claim 3, further comprising a guide member connected to the lower end of the rod, having a plurality of rollers supporting tops and bottoms of the connectors, and having a U-shaped bracket combined with the rollers.

5. The apparatus of claim 1, further comprising a magazine catch button pusher connected to the handle in parallel with the bar to press a magazine catch button.

6. The apparatus of claim 1, further comprising a magazine ejector disposed outside the magazine chamber and having a pointed end disposed between adjacent clips of the multi-magazine mount.

7. The apparatus of claim 2, further comprising a rack guide guiding up-down movement of the rack bar, the rack guide has a hole for inserting the rack bar and integrally connected to the U-shaped bracket of the guide member.

* * * * *